US005370434A

United States Patent [19]

Kellett

[11] Patent Number: 5,370,434

[45] Date of Patent: Dec. 6, 1994

[54] RETRIEVAL DEVICE FOR FLOATING OBJECTS HAVING AN EXTENSIBLE LINE AND HOUSING THEREFOR

[76] Inventor: K. Craige Kellett, R.R. #1, Minden, Ontario, Canada, K0M 2K0

[21] Appl. No.: 82,771

[22] Filed: Jun. 28, 1993

[51] Int. Cl.[5] ..... B25J 1/00; B65H 75/40

[52] U.S. Cl. ..... 294/66.1; 242/405.3; 441/84

[58] Field of Search ..... 294/19.1, 19.2, 55, 294/66.1, 82.11; 15/104.31-104.33; 16/115; 43/7, 11, 12; 52/121; 242/84.8, 85, 85.1, 96, 129; 254/134.3 FT; 441/80, 84, 85

[56] References Cited

U.S. PATENT DOCUMENTS

| | | | |
|---|---|---|---|
| 138,541 | 5/1873 | Stiles . | |
| 411,161 | 9/1889 | Maynard | 441/84 |
| 537,674 | 4/1895 | Collins | 441/85 |
| 946,798 | 1/1910 | Franz . | |
| 3,092,412 | 6/1963 | Drake . | |
| 3,097,373 | 7/1963 | Wisti | 441/85 |
| 3,141,696 | 7/1964 | Nau | 294/19.2 |
| 3,319,987 | 5/1967 | Bohr et al. | 294/19.1 |
| 3,465,986 | 9/1969 | Milly | 294/19.1 X |
| 3,533,599 | 10/1970 | Hindenburg | 242/84.8 X |
| 4,014,478 | 3/1977 | Bonacina . | |
| 4,061,290 | 12/1977 | Harrill | 242/96 |
| 4,108,484 | 8/1978 | Malroit . | |
| 4,184,356 | 1/1980 | Wittmer . | |
| 4,223,465 | 9/1980 | Nichols . | |
| 4,263,864 | 4/1981 | Carter, Jr. . | |
| 4,441,746 | 4/1984 | Corboy, Jr. . | |
| 4,599,074 | 7/1986 | Beckly . | |
| 4,679,348 | 7/1987 | Wimberley . | |
| 4,702,507 | 10/1987 | Medendorp . | |

FOREIGN PATENT DOCUMENTS

| | | | |
|---|---|---|---|
| 21752 | of 1908 | United Kingdom | 441/84 |
| 312464 | 5/1929 | United Kingdom | 441/80 |

*Primary Examiner*—Johnny D. Cherry

[57] ABSTRACT

The invention provides a retrieval device for retrieving floating objects from the surface of a body of water. The device comprises an extensible boom formed by a semi-rigid, non-resilient, buoyant cable and a grab device attached to one end of the cable. The cable is adapted to be stowed within a portable housing when not in use, and to be extended therefrom for use. The housing is a hollow, doughnut-shaped housing providing a toroidally-shaped interior passage adapted to accommodate the cable and to coil it as it is inserted into the passage.

6 Claims, 2 Drawing Sheets

RETRIEVAL DEVICE FOR FLOATING OBJECTS HAVING AN EXTENSIBLE LINE AND HOUSING THEREFOR

This invention relates to a portable retrieval device for retrieving floating objects from the surface of a body of water, such as a lake, and is particularly adapted for use by sportsmen for retrieving lures, game and the like lying out of reach from the shore, and for emergency rescue operations of an analogous nature. A device according to the invention is of simple construction, easy to use, and convenient to handle.

Basically, the retrieval device comprises an extensible boom with object retrieving means, herein called a grab, mounted at its outboard end, for retrieving an object lying out of reach from the shore, and a portable housing particularly designed to house the boom in a coiled condition.

Thus, according to the present invention, a portable retrieval device for retrieving floating objects from the surface of a body of water comprises a semi-rigid, non-resilient, buoyant cable having an outboard end and an inboard end, attachment means at said outboard end for attaching a grab thereto, a housing for said cable, the housing comprising a hollow casing defining a toroidally-shaped interior passage having a tangential opening, the passage being adapted to house the cable in coiled condition with the outboard end of the cable projecting from said opening, the cable being extensible from the casing through said opening to form a grab-supporting boom.

The cable is essentially semi-rigid, that is to say, it is flexible but substantially non-resilient so that it will retain the shape into which it is flexed. Preferably, the cable is a coaxial cable having a steel core and an aluminum sheath.

A preferred embodiment of the invention will now be described, by way of example, with reference to the accompanying drawings. In the drawings, FIG. 1 is a perspective view of the retrieval device, showing the extensible boom, its housing, and a grab mounted at the outboard end of the boom;

Figure 3:
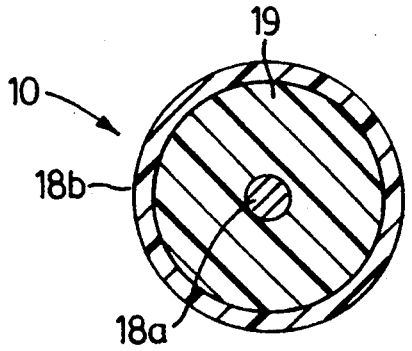
FIG. 3 is a cross-sectional view of a cable constituting the boom taken on line 3—3 in FIG. 1.
Figure 1:
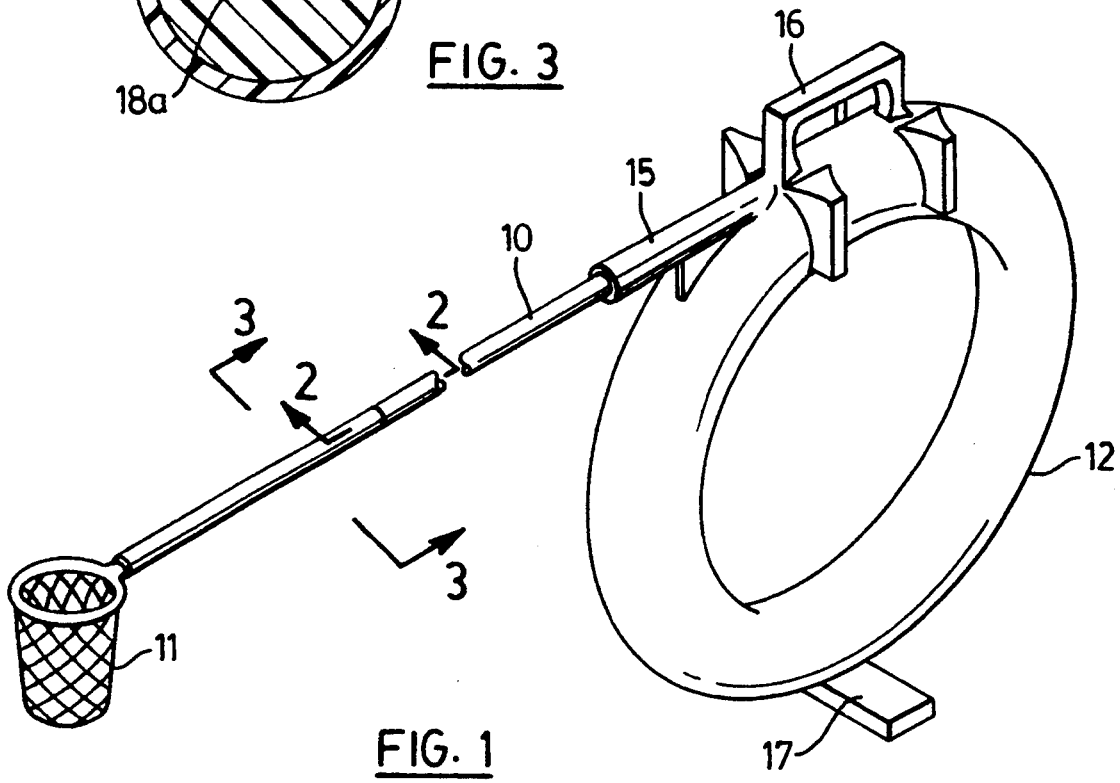
Figure 6:
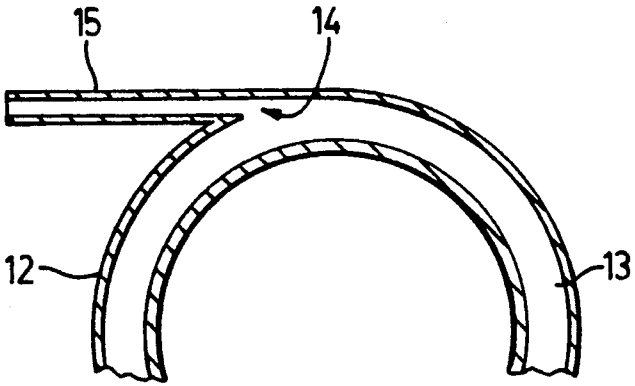
FIG. 6 is a partial cross-section view of the device of FIG. 1.
Figure 4:
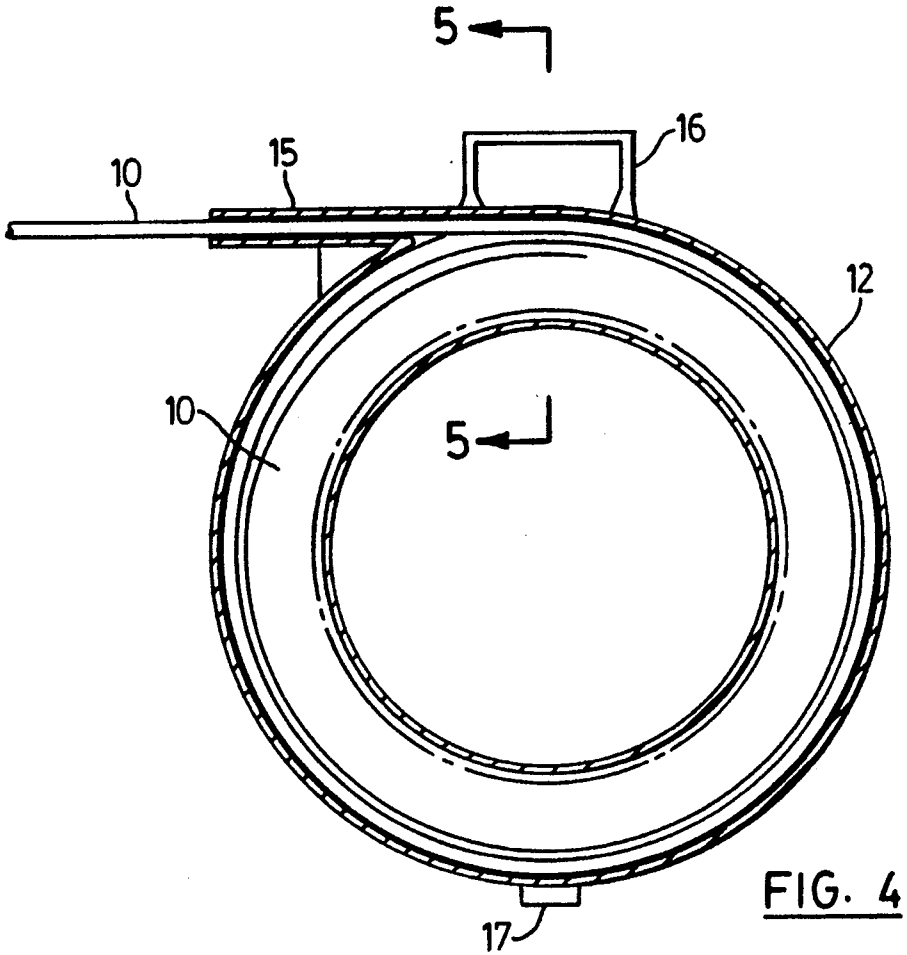
FIG. 4 is a vertical sectional view of the retrieval device shown in FIG. 1.

Referring to the drawings, the portable retrieval device of the present invention comprises a semi-rigid buoyant cable 10 having an outboard end formed with attachment means, as hereinafter described, for attaching a grab device 11, such as a net, grab hook or the like, thereto for engaging an object to be retrieved from the surface of a body of water such as a lake. The cable 10 is adapted to be stowed in coiled condition in a housing designed to accommodate the cable. The housing comprises a lightweight hollow casing 12, preferably of aluminum or moulded plastic, the casing being doughnut-shaped as shown in FIG. 1 so as to define therein a toroidally shaped interior passage 13 for housing the cable 10 in the coiled condition, as shown in FIG. 4. In the detailed sectional view shown in FIG. 6 the cable 10 has been omitted so as to show the interior passage 13, which has a tangential opening 14 through which the cable 10 can be passed into and extended from the passage 13. The passage 13 need not be of circular cross section as shown, although this is preferred, but may be of any section that will accommodate the cable and cause the cable to coil along the passage as it is inserted. The casing 12 is formed with an integral spout 15 extending tangentially from the casing 12 and communicating with the opening 14. As shown in FIG. 4, the cable extends through the spout 15, the cable 10 being housed in coiled condition in the passage 13 with the outboard end of the cable projecting through the opening 14 and the spout 15.

The casing is furthermore formed with a handle portion 16 to facilitate carrying the device, and a stand portion 17 enabling the casing to be stood in an upright position.

The cable 10 is essentially semi-rigid, that is to say, it is flexible, non-resilient and has sufficient rigidity to enable it to retain a shape into which it is flexed. Thus, the cable, when fed into the interior passage 13 of the casing 12, will be shaped into the coiled condition shown in FIG. 4 by its engagement with the wall of the passage. On the other hand, the cable 10, serving as an extensible boom, can be extended from the casing via the spout 15 which will straighten the cable as it is passed through the spout. To meet these requirements, the cable is preferably a coaxial cable, having a steel core **18*a*, an aluminum sheath 18*b*, a filling 19** of polystyrene or similar lightweight plastic, and an outer sheath (not shown) of plastic such as polyethylene.

Figure 2:
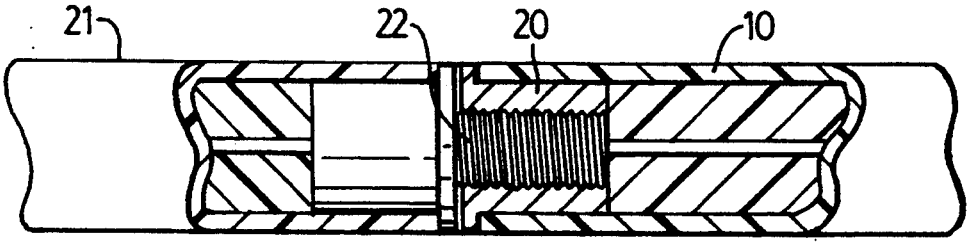
FIG. 2 is a sectional view taken on line 2—2 in FIG. 1.
Figure 5:
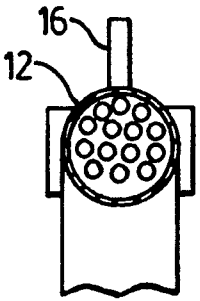
FIG. 5 shows a detail of FIG. 4 taken on line 5—5 therein.

The cable 10 has an attachment 20 at its outboard end for attaching a grab device thereto. In the embodiment of the invention illustrated in FIG. 1, the attachment 20 can be used to attach either a grab device such as the net 11 thereto, or to attach a further cable section 21 in the manner shown in FIG. 2. Thus, the outboard end of the cable 10, and one end of each further cable section to be attached to it, is formed with a first coupling member such as a screw socket 20, while the other end of each said further cable section, as well as the grab device 11, is formed with a complementary coupling member such as a threaded plug 22. Alternatively, the coupling members may be a tongue and clevis.

While the portable housing 12 enhances the utility of the retrieval device since it enables the cable 10 to be conveniently stowed and extended or retracted as required, the device can be used without the casing. Thus, according to another aspect of the invention described above, there is provided a retrieval device for retrieving floating objects from the surface of a body of water comprising a semi-rigid, non-resilient, buoyant cable and a grab device adapted to be coupled to one end of the cable, said one end of the cable and the grab device being formed with respective attachment means constituted by complementary coupling members. The invention also provides such a retrieval device comprising a plurality of lengths of semi-rigid, non-resilient, buoyant cable each formed with a first coupling member at one end and a complementary coupling member at its other end for interconnecting said cable lengths end to end and a grab device formed with attachment means cooperable with each of said first coupling members for attaching the grab device thereto.

I claim:

1. A portable retrieval device for retrieving floating objects from the surface of a body of water, comprising a semi-rigid, non-resilient, buoyant cable having an outboard end and an inboard end, attachment means at said outboard end for attaching a grab thereto, a housing for said cable, the housing comprising a hollow casing defining a toroidally-shaped interior passage having a tangential opening, the passage housing the cable in coiled condition with the outboard end of the cable projecting from said opening, the cable being extensible from the casing through said opening to form a grab-supporting boom.

2. A portable retrieval device according to claim 1, wherein the casing is formed with an integral spout extending tangentially from said opening, the cable extending through the spout.

3. A portable retrieval device according to claim 2, wherein the casing further comprises a handle portion to facilitate carrying same and a stand portion enabling the casing to be stood in an upright position.

4. A portable retrieval device according to claim 1, wherein the cable comprises a plurality of cable sections coupled end to end.

5. A portable retrieval device according to claim 1, further comprising at least one additional semi-rigid, non-resilient, buoyant cable having first attachment means at one end for attaching a grab thereto and second attachment means at its other end, said second attachment means of the first-mentioned cable for interconnecting the cables end to end.

6. A portable retrieval device according to claim 1, wherein the cable is a coaxial cable having a steel core, an aluminum sheath, and a filling of lightweight plastic material.

* * * * *